United States Patent [19]

Romanowski

[11] 4,074,096

[45] Feb. 14, 1978

[54] BELLOWS CONTROLLED SUDDEN PRESSURE RISE RELAY

[75] Inventor: Robert F. Romanowski, Rochester, N.Y.

[73] Assignee: Qualitrol Corporation, Fairport, N.Y.

[21] Appl. No.: 730,200

[22] Filed: Oct. 6, 1976

[51] Int. Cl.[2] ..... H01H 35/32

[52] U.S. Cl. ..... 200/83 D; 200/81.5; 60/545

[58] Field of Search ..... 200/83 C, 83 D, 81.5, 200/153 T; 340/229, 240; 60/545

[56] References Cited

U.S. PATENT DOCUMENTS 3,535,878 10/1970 Romanowski ..... 60/545

*Primary Examiner*—Gerald P. Tolin

*Attorney, Agent, or Firm*—Stephen J. Rudy

[57] ABSTRACT

A relay unit associated with a fluid cooled transformer apparatus. The relay utilizes an hydraulic bellows circuit system to sense internal pressure changes developing in a tank member of the transformer apparatus; and it responds to a sudden rise in the pressure to operate an alarm switch. The system includes a group of three bellows, one of which reacts to pressure changes in the tank; and the other two of which respond according to the reaction of the first in controlling operation of the switch. A pivoted bracket and supporting spring arrangement associated with the bellows serves to control operation of the switch and to restrain it from being operated by shocks and the like attendant upon seismic conditions.

5 Claims, 1 Drawing Figure

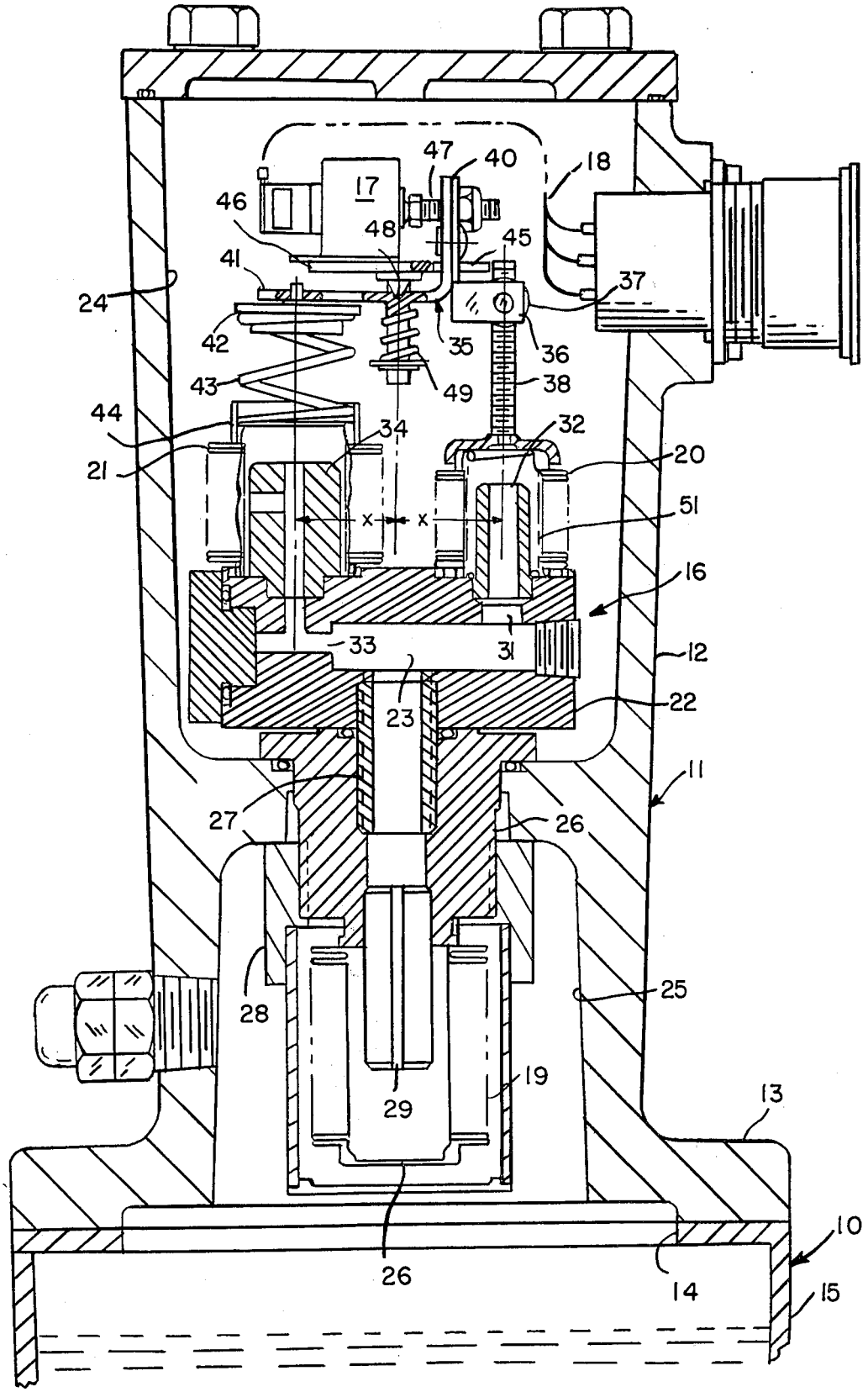
47
40
18
17
46
48
45
41
37
24
42
35
36
43
49
38
44
34
32
21
20
51
x
x
16
33
31
12
23
22
11
27
26
28
25
19
29
13
10
26
14
15

BELLOWS CONTROLLED SUDDEN PRESSURE RISE RELAY

BACKGROUND OF THE INVENTION

This invention is concerned with improvements in a fluid bellows controlled pressure relay of a type designed to operate an alarm switch in response to a sudden rise in the internal pressure developing in a tank with which the relay is associated.

The relay is especially suited for use as a protective device for a fluid cooled electrical transformer apparatus so as to sense development of an abnormal pressure rise in the apparatus, and to issue a warning signal that would require an attendant to inspect the apparatus for the cause of the pressure rise.

A feature of the invention lies in the particular organization of its components whereby its operation is reliable in areas subject to strong vibrations and shock such as may occur under seismic conditions.

In accordance with the invention, there is provided a fluid bellows controlled pressure relay comprising a housing having a lower open end adapted to be mounted over a complementary opening in a pressure developing tank, a bellows support block mounted in the housing, a pressure sensing bellows mounted to an underside of the block having a bottom end adapted to be subjected to pressures applied through said lower open end, a second vertically extending bellows mounted to an upper surface of the block, a third bellows mounted to the upper surface of the block in spaced parallel relation to the second bellows, the interiors of the several bellows being connected in communication with a common channel in the block, the channel and connected bellows defining a closed hydraulic circuit filled with fluid, a switch having a push-pin switch contact in an electrical alarm circuit, a bracket pivoted intermediately of its ends to a stationary support and supported in a balanced condition at its ends upon the second and third bellows, a switch actuating element carried by the bracket disposed in the balanced condition of the bracket in ineffective abutting relation to the push-pin switch contact, the second bellows having an orifice communicating its interior with the common channel, and the third bellows having a relatively larger port communicating its interior with the common channel, the sensing bellows being contractible upon sensing pressure variations applied through said lower open end to force fluid from the channel to the orifice and larger port respectively of the second and third bellows, the second bellows having a larger diameter area subject to pressures from the channel fluid entering the orifice than the third bellows has subject to pressure from the channel at the larger port, the second and third bellows being responsive to normal pressure changes from the channel in such manner as to maintain the bracket in neutral position whereby the switch actuating element will not actuate the push-pin switch contact, and the second and third bellows being responsive to sudden pressure changes from the channel in such manner that the bracket is caused to swing about its pivot to cause the switch actuating element to actuate the push-pin switch contact.

BRIEF DESCRIPTION OF THE DRAWING

The FIGURE in the accompanying drawing is a vertical section of a relay embodying the invention, a fragmentary portion of a fluid cooled electrical transformer to which the relay has been applied being shown.

DESCRIPTION OF A PREFERRED EMBODIMENT OF THE INVENTION

Reference is now directed to the drawing wherein is shown a conventional fluid cooled electrical transformer apparatus 10 to which a protective pressure responsive relay 11 embodying the invention has been applied.

The relay 11 includes a housing 12 having a base flange 13 mounted over an opening 14 in a wall of a tank member 15 of the transformer apparatus. The tank is sealed; and it contains the usual cooling fluid in which the electrical coil winding (not shown) of the transformer is immersed. The relay includes a closed pressure responsive bellows hydraulic circuit system 16. The latter responds to a predetermined sudden rise developing in the internal pressure of the tank to actuate an alarm switch 17 in an electrical control circuit 18. The system also responds to normal pressure changes in the tank, but does so without actuating the switch.

The system 16 includes a group of three bellows 19, 20 and 21. Bellows 19, which is a pressure sensing bellows, reacts to pressure changes in the tank; and bellows 20 and 21 respond according to the reaction of bellows 19 in controlling actuation of the switch.

The three bellows are of an axially expanding type. They are mounted to a supporting block 22; and their interiors are interconnected with each other in a closed fluid filled circuit by means of a common channel 23. The block is located in an upper compartment 24 of the housing centrally of the three bellows.

The pressure sensing bellows 19 is located in a lower recess 25 of the housing with its bottom end 26 exposed through the opening 14 in the tank to whatever pressures may develop in the latter. The upper end of bellows 19 is fixed to a bushing 26 which extends through a neck into the housing and is connected by means of a pipe nipple 27 to the underside of block 22. A collar nut 28 locks the bushing in place. The interior of bellows 19 communicates through a passage 29 in a bellows contraction stop tube, and through the pipe nipple 27 with the common channel 23.

The pressure responsive bellows 20 and 21 are mounted atop the block 22 and extend upwardly in parallel spaced relation to each other. The common channel 23 connects through a port 31 and a bellows contraction stop tube 32 with the interior of bellows 20; and it connects through an orifice or more restricted port 33 and a bellows contraction stop tube 34 with the interior of bellows 21.

A switch actuating bracket 35 is supported at its ends in a balanced condition by means of bellows 20 and 21, and spring 43. In this respect, a yoke 36 at one end of the bracket, and secured to the bracket 35, is pivoted upon a nut 37 threaded upon a post 38. The latter extends upwardly from a base cap mounted to the top of bellows 20. Extending away from the back of the yoke is a flat arm 41 which rests at its end upon a plate 42 fitted to the top of a spring 43. The latter is seated in a tubular cap 44 atop bellows 21. A pin retains arm 41 to plate 42. Intermediately of the ends of the bracket is an upright panel portion 40 which extends through a guide slot 45 formed in a stationary shelf 46.

Threaded transversely of panel 40 is a switch actuating screw 47. The bracket is seated against a pivot point 48 fixed to the underside of the shelf. The pivot point 48 is positioned equidistant from the axis of bellows 20 and 21. A spring 49 axially aligned wtth the pivot point is supported on a lug extending from the underside of the shelf. The spring biases the bracket into seated relation with the pivot point.

The alarm switch 17 is mounted atop shelf 46, and has a push-pin contact adapted to be actuated by the head of the actuating screw 47 when bracket 35 is pivoted counter-clockwise toward the push-pin.

Bellows spring 43 biases the bracket about its pivot in a clockwise direction so as to urge screw 47 to maintain its position to the push-pin. This tendency is counteracted by an expansion spring 51 in bellows 20 and by a proper height adjustment of the nut 37 upon post 38 so as to hold the bracket in a normal condition of balance of equilibrium in which the actuating screw under the bias of spring 43 lies in close relation to the push-pin.

It can be seen that a counterclockwise force sufficient to overcome the bias of the heavy spring 43 is required to effect pivoting of the bracket to actuate the push-pin.

The several bellows and their connecting passages are filled with a suitable fluid, such as silicon oil, conventional to bellows of this nature.

It is to be noted that the effective diameter area of bellows 20 that is subject to fluid pressure is relatively smaller than that of bellows 21, so that it will deflect less than bellows 21 for a given increase of internal pressure. Also, bellows 21 and the sensing bellows 19 are the same in size and effective areas.

In summary of the operation of the relay, a slow progressive contraction of the sensing bellows 19 in response to normal pressure changes in the transformer tank will force fluid from sensing bellows 19 through common channel through the restriction 33 and into the bellows 21, no fluid will flow into the bellows 20. The following reason is explanatory.

In order for this device to operate in its most sensitive and effective way, the bracket 35 must always be in neutral position during normal pressure rise and fall, i.e., bellows 20 cannot change its height, therefore, no fluid enters or leaves bellows 20 and this can be accomplished only when the spring 43 has the proper "spring rate" which depends on the effective areas and "spring rates" of the bellows 20 and 21.

Bellows 21 will increase in length the same amount that bellows 19 will decrease and spring 43 will compress the same distance by having the proper "spring rate"; the load generated by the spring 43 and transmitted via bracket 35 and screw 38 onto the bellows 20 will maintain the bracket 35 in neutral position because of the difference in effective areas of bellows 20 and 21. Since bellows 21 has a larger effective area it will generate more force than bellows 20 and this force in terms of deflection in inches is used to calculate the proper "spring rate" for spring 43.

But, should there by an abnormal or sudden rise in the transformer tank pressure, causing a sharp contraction of the sensing bellows 19, the fluid in channel 23 will pass in greater volume through the larger port 31 to effect an expansion of bellows 20 before any expansion can be effected in bellows 21. Accordingly, the switch actuating bracket will be pivoted counterclockwise to actuate the switch, causing a signal to be established through the circuit 18 to an external alarm device (not shown).

The particular manner of association of the bracket element 35 with the bellows, together with the support provided by the associated spring elements, avoids an unwanted operation of the switch under excessive vibrations, such as shocks attendant upon seismic conditions.

I claim:

1. A fluid bellows controlled pressure relay comprising a housing having a lower open end adapted to be mounted over a complementary opening in a pressure developing tank, a bellows support block mounted in the housing, a pressure sensing bellows mounted to an underside of the block having a bottom end adapted to be subjected to pressures applied through said lower open end, a second vertically extending bellows mounted to an upper surface of the block, a third bellows mounted to the upper surface of the block in spaced parallel relation to the second bellows, the interiors of the several bellows being connected in communication with a common channel in the block, the channel and connected bellows defining a closed hydraulic circuit filled with fluid, a switch having a push-pin switch contact in an electrical alarm circuit, a bracket pivoted intermediately of its ends to a stationary support and supported in a balanced condition at its ends upon the second and third bellows, a switch actuating element carried by the bracket disposed in the balanced condition of the bracket in ineffective abutting relation to the push-pin switch contact, the second bellows having an orifice communicating its interior with the common channel, and the third bellows having a relatively larger port communicating its interior with the common channel, the sensing bellows being contractible upon sensing pressure variations applied through said lower open end to force fluid from the channel to the orifice and larger port respectively of the second and third bellows, the second bellows having a larger diameter area subject to pressures from the channel fluid entering the orifice than the third bellows has subject to pressure from the channel at the larger port, the second and third bellows being responsive to normal pressure changes from the channel in such manner as to maintain the bracket in neutral position whereby the switch actuating element will not actuate the push-pin switch contact, and the second and third bellows being responsive to sudden pressure changes from the channel in such manner that the bracket is caused to swing about its pivot to cause the switch actuating element to actuate the push-pin switch contact.

2. A fluid bellows controlled pressure relay as in claim 1, wherein a coil spring seated atop the second bellows supports at its upper end one end of the bracket, and a post mounted atop the third bellows carries a yoke pivoted to the post and supporting an opposite end of the bracket.

3. A fluid bellows controlled pressure relay as in claim 2, wherein a nut adjustable along the post carries a pivot pin upon which the yoke is pivoted.

4. A fluid bellows controlled pressure relay as in claim 3, wherein the bracket is pivoted upon a pivot point, and a spring axially aligned with the pivot point biases the bracket upon the latter.

5. A fluid bellows controlled pressure relay as in claim 4, wherein a bellows contraction stop element is arranged in each bellows.

* * * * *